US006199216B1

(12) United States Patent
Weatherspoon

(10) Patent No.: US 6,199,216 B1
(45) Date of Patent: Mar. 13, 2001

(54) SOCK WITH POCKET

(76) Inventor: Rose M. Weatherspoon, 305 E. Tamarack Ave., Inglewood, CA (US) 90301

( * ) Notice: Subject to any disclaimer, the term of this patent is extended or adjusted under 35 U.S.C. 154(b) by 0 days.

(21) Appl. No.: 09/292,574

(22) Filed: Apr. 15, 1999

(51) Int. Cl.[7] ..... A43B 17/00; A41D 27/20
(52) U.S. Cl. ..... 2/239; 2/247
(58) Field of Search ..... 2/239; 1/247

(56) References Cited

U.S. PATENT DOCUMENTS

D. 344,175 * 2/1994 Decker ..... D2/992
781,056 * 1/1905 Duncan .
790,595 * 5/1905 Scott .
1,117,591 * 11/1914 Morningstar .
1,128,941 * 2/1915 Brown .
2,814,807 * 6/1957 Dollar .
2,890,461 * 6/1959 Hartman et al. .
4,005,494 * 2/1977 Burn ..... 2/239
4,038,699 * 8/1977 Burn ..... 2/239
4,445,233 * 5/1984 Rubin ..... 2/239
4,532,656 * 8/1985 Suzuki ..... 2/247
4,961,235 * 10/1990 Williger ..... 2/239
5,027,440 * 7/1991 Morris et al. ..... 2/239
5,133,091 * 7/1992 del Valle Mas ..... 2/239
5,625,904 * 5/1997 Kline ..... 2/239
5,651,142 * 7/1997 del Valle Mas ..... 2/239
5,664,263 * 9/1997 Reynolds ..... 2/239
5,836,019 * 11/1998 McCafferty ..... 2/239

* cited by examiner

*Primary Examiner*—John J. Calvert
*Assistant Examiner*—Alissa L. Hoey

(57) ABSTRACT

A sock with pocket for storing items. The sock with pocket includes a foot portion and a leg portion extending from the foot portion. A pocket flap is coupled to the leg portion and forms a pocket between the flap and the leg portion. A cover flap is coupled to the leg portion and folds over an upper edge of the pocket flap for closing the pocket. The cover flap is detachably couplable to the pocket flap.

9 Claims, 2 Drawing Sheets

SOCK WITH POCKET

BACKGROUND OF THE INVENTION

1. Field of the Invention

The present invention relates to socks and more particularly pertains to a new sock with pocket for storing items.

2. Description of the Prior Art

The use of socks is known in the prior art. More specifically, socks heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,027,440; U.S. Pat. No. 4,038,699; U.S. Pat. No. 5,625,904; U.S. Pat. No. Des. 344,175; U.S. Pat. No. 2,890,461; U.S. Pat. No. 4,961,235; U.S. Pat. No. 4,005,494; U.S. Pat. No. 4,040,275; U.S. Pat. No. 5,230,333; U.S. Pat. No. 5,133,091; and U.S. Pat. No. 5,157,791.

While these devices fulfill their respective, particular objectives and requirements, the aforementioned patents do not disclose a new sock with pocket. The inventive device includes a foot portion and a leg portion extending from the foot portion. A pocket flap is coupled to the leg portion and forms a pocket between the flap and the leg portion. A cover flap is coupled to the leg portion and folds over an upper edge of the pocket flap for closing the pocket. The cover flap is detachably couplable to the pocket flap.

In these respects, the sock with pocket according to the present invention substantially departs from the conventional concepts and designs of the prior art, and in so doing provides an apparatus primarily developed for the purpose of storing items.

SUMMARY OF THE INVENTION

In view of the foregoing disadvantages inherent in the known types of socks now present in the prior art, the present invention provides a new sock with pocket construction wherein the same can be utilized for storing items.

The general purpose of the present invention, which will be described subsequently in greater detail, is to provide a new sock with pocket apparatus and method which has many of the advantages of the socks mentioned heretofore and many novel features that result in a new sock with pocket which is not anticipated, rendered obvious, suggested, or even implied by any of the prior art socks, either alone or in any combination thereof.

To attain this, the present invention generally comprises a foot portion and a leg portion extending from the foot portion. A pocket flap is coupled to the leg portion and forms a pocket between the flap and the leg portion. A cover flap is coupled to the leg portion and folds over an upper edge of the pocket flap for closing the pocket. The cover flap is detachably couplable to the pocket flap.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new sock with pocket apparatus and method which has many of the advantages of the socks mentioned heretofore and many novel features that result in a new sock with pocket which is not anticipated, rendered obvious, suggested, or even implied by any of the prior art socks, either alone or in any combination thereof.

It is another object of the present invention to provide a new sock with pocket which may be easily and efficiently manufactured and marketed.

It is a further object of the present invention to provide a new sock with pocket which is of a durable and reliable construction.

An even further object of the present invention is to provide a new sock with pocket which is susceptible of a low cost of manufacture with regard to both materials and labor, and which accordingly is then susceptible of low prices of sale to the consuming public, thereby making such sock with pocket economically available to the buying public.

Still yet another object of the present invention is to provide a new sock with pocket which provides in the apparatuses and methods of the prior art some of the advantages thereof, while simultaneously overcoming some of the disadvantages normally associated therewith.

Still another object of the present invention is to provide a new sock with pocket for storing items.

Yet another object of the present invention is to provide a new sock with pocket which includes a foot portion and a leg portion extending from the foot portion. A pocket flap is coupled to the leg portion and forms a pocket between the flap and the leg portion. A cover flap is coupled to the leg portion and folds over an upper edge of the pocket flap for closing the pocket. The cover flap is detachably couplable to the pocket flap.

Still yet another object of the present invention is to provide a new sock with pocket that stores items such as money, credit cards, identification and the like out of view.

Even still another object of the present invention is to provide a new sock with pocket that may eliminate the need to carry a wallet or purse.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
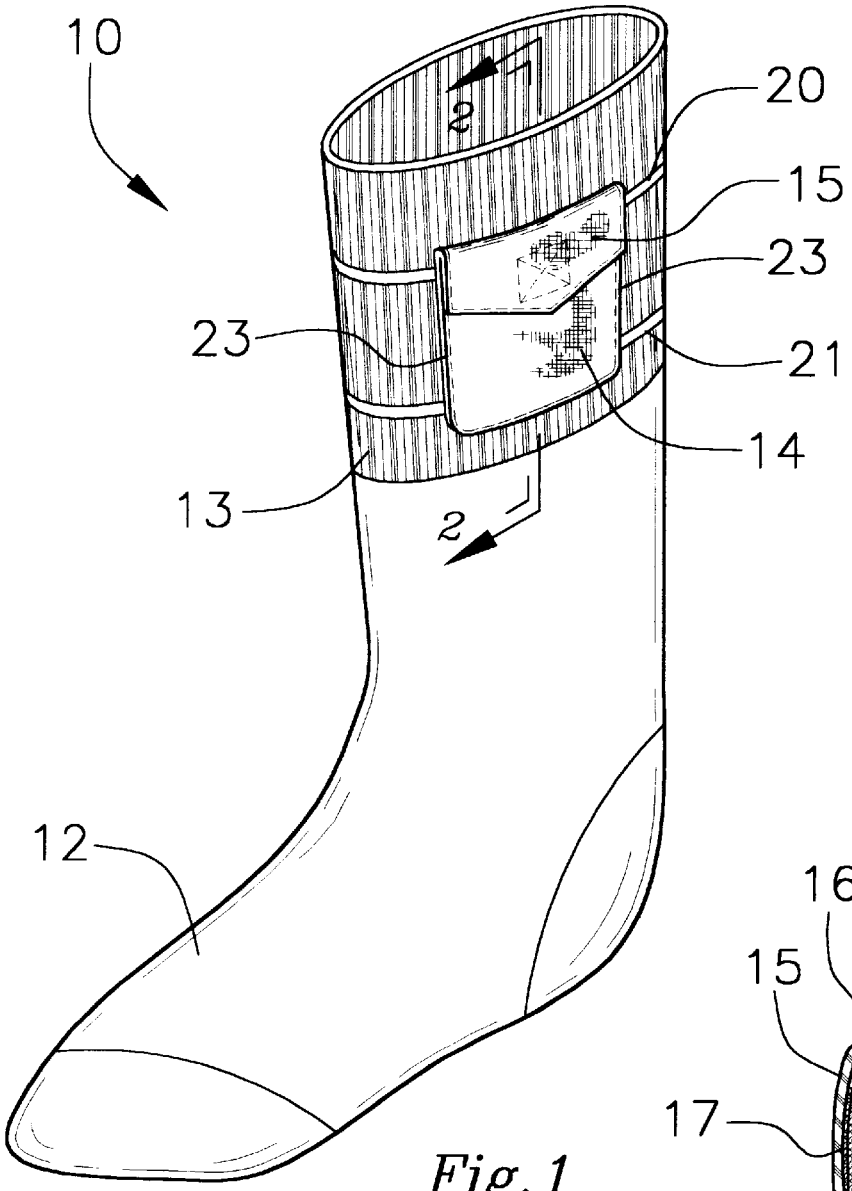
FIG. 1 is a schematic perspective view of a new sock with pocket according to the present invention.
Figure 2:
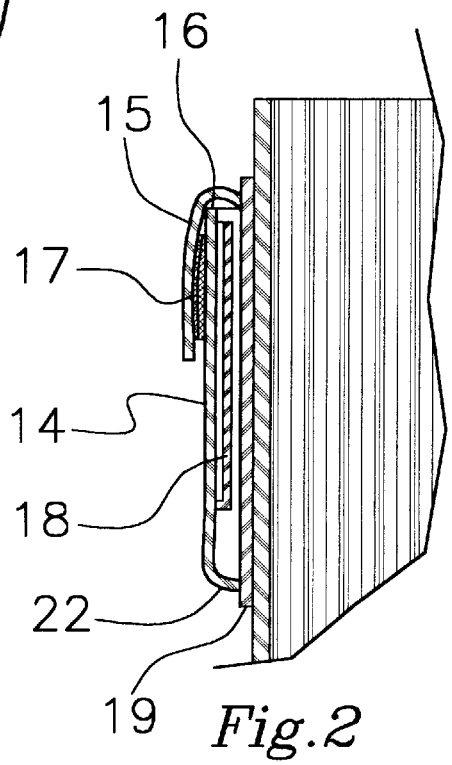
FIG. 2 is a schematic cross sectional view of the present invention taken from line 2—2 of FIG. 1.
Figure 3:
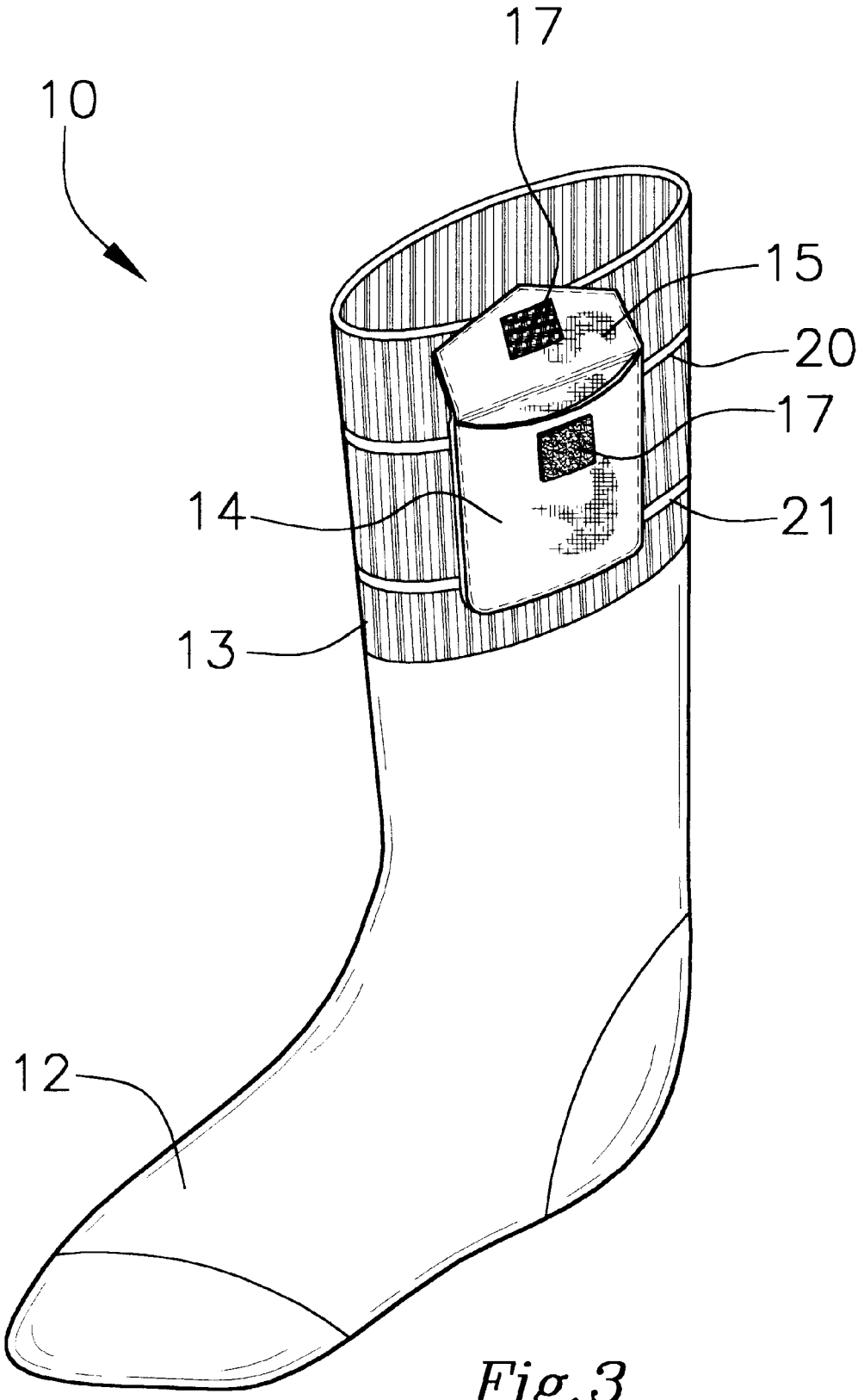
FIG. 3 is a schematic perspective view of the present invention.

With reference now to the drawings, and in particular to FIGS. 1 through 3 thereof, a new sock with pocket embodying the principles and concepts of the present invention and generally designated by the reference numeral 10 will be described.

As best illustrated in FIGS. 1 through 3, the sock with pocket 10 generally comprises a foot portion 12 and a leg portion 13 extending from the foot portion. A pocket flap 14 is coupled to the leg portion and forms a pocket between the pocket flap and the leg portion. A cover flap 15 is coupled to the leg portion and folds over an upper edge 16 of the pocket flap for closing the pocket. The cover flap is detachably couplable to the pocket flap.

Preferably, the cover flap and the pocket flap each have complementary portions of a hooks and loops fastener 17 coupled to them.

Also preferably, a key flap 18 is coupled to an inner surface of the pocket flap and forms a key pocket between the key flap and the pocket flap.

Optionally, a layer of padding 19 may be positioned between the pocket flap and the leg portion. The layer of padding prevents the objects held in the pockets from poking the leg of the wearer, thereby causing discomfort.

Also optionally, a first elastic strap 20 extends around the leg portion and is coupled to the layer of padding or the pocket flap for bending objects held in the pocket to conform to the contour of the leg of a wearer. Ideally, a second elastic strap 21 is spaced apart from the first elastic strap and extends around the leg portion and coupled to the layer of padding or the pocket flap for bending objects held in the pocket to conform to the contour of the leg of a wearer. The second elastic strap is used in conjunction with the first elastic strap to more effectively bend the objects in the pocket into conformity with the contour of the leg. The elastic straps also improve concealment of the pocket.

The preferred height of the pocket flap between its upper edge and lower end 22 is about 4½ inches. The preferred width of the pocket flap between its lateral sides 23 is about 2 inches. These dimensions are required to ensure concealment of the pocket below a pant leg. The slim design prevents bulging of the lateral sides of the pocket, which could disclose the existence of the pocket. The key flap should be about ½ as wide as the pocket flap.

In use, the cover flap is detached from the pocket flap and objects such as money, identification, and the like are placed in the pocket formed between the pocket flap and the layer of padding. A key or keys may be placed in the pocket formed between the key flap and the pocket flap. The cover flap is then reattached to the pocket flap and the pant leg is pulled down over the leg portion to conceal the pocket.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A sock, comprising:

a foot portion and a leg portion extending from said foot portion;

a pocket flap coupled to said leg portion and forming a pocket between said pocket flap and said leg portion; and a cover flap coupled to said leg portion and folding over an upper edge of said pocket flap for closing said pocket;

said cover flap being detachably couplable to said pocket flap;

a key flap coupled to an inner surface of said pocket flap and forming a key pocket between the key flap and the pocket flap;

a layer of padding positioned between said pocket flap and said leg portion; and wherein said key pocket is positioned such that objects placed in said pocket are positioned between said key flap and said padding thereby facilitating retrieval of objects placed in said key pocket while retaining objects in said pocket.

2. The sock of claim 1, wherein said cover flap and said pocket flap each have complementary portions of a hooks and loops fastener coupled thereto.

3. The sock of claim 1, further comprising a first elastic strap extending around said leg portion and coupled to said pocket flap.

4. The sock of claim 3, further comprising a second elastic strap being spaced apart from said first elastic strap and extending around said leg portion and coupled to said pocket flap.

5. The sock of claim 1, further comprising an first elastic strap extending around said leg portion and coupled to said layer of padding.

6. The sock of claim 5, further comprising a second elastic strap being spaced apart from said first elastic strap and extending around said leg portion and coupled to said layer of padding.

7. The sock of claim 1, wherein a height of said pocket flap is defined between said upper edge and a lower end thereof, said height of said pocket flap being about 4½ inches.

8. The sock of claim 1, wherein a width of said pocket flap is defined between lateral sides thereof, said width of said pocket flap being about 2 inches.

9. A sock, comprising:

a foot portion and a leg portion extending from said foot portion;

a pocket flap coupled to said leg portion and forming a pocket between said pocket flap and said leg portion;

a cover flap coupled to said leg portion and folding over an upper edge of said pocket flap for closing said pocket;

said cover flap being detachably couplable to said pocket flap;

said cover flap and said pocket flap each having complementary portions of a hooks and loops fastener coupled thereto;

a key flap coupled to an inner surface of said pocket flap and forming a key pocket between the key flap and the pocket flap;

a layer of padding positioned between said pocket flap and said leg portion, said padding adapted for preventing objects held in said pocket from scratching the leg of a user;

wherein said key pocket is positioned such that objects placed in said pocket are positioned between said key flap and said padding thereby facilitating retrieval of objects placed in said key pocket while retaining objects in said pocket;

a first elastic strap extending around said leg portion and coupled to said layer of padding;

a second elastic strap being spaced apart from said first elastic strap and extending around said leg portion and coupled to said layer of padding;

wherein said first and second elastic straps are for providing additional support to said pocket and said key pocket when objects are in said pocket and said key pocket such that said leg portion is adapted for remaining secured around a leg of a user;

wherein a height of said pocket flap is defined between said upper edge and a lower end thereof, said height of said pocket flap being about 4½ inches; and wherein a width of said pocket flap is defined between lateral sides thereof, said width of said pocket flap being about 2 inches.

* * * * *